United States Patent [19]

Landa et al.

[11] Patent Number: 4,871,163

[45] Date of Patent: Oct. 3, 1989

[54] PAPER CONTROL GATE

[75] Inventors: Benzion Landa, Edmonton, Canada; Christopher J. Blake, Apalachin; Gerald R. Housworth, Owego, both of N.Y.; Shai Lior, Rehovot, Israel

[73] Assignee: Savin Corporation, Stamford, Conn.

[21] Appl. No.: 196,410

[22] Filed: May 20, 1988

Related U.S. Application Data

[63] Continuation of Ser. No. 871,800, Jun. 9, 1986, abandoned.

[51] Int. Cl.[4] ..... B65H 5/00

[52] U.S. Cl. ..... 271/225; 271/298; 271/301; 271/303; 271/184; 271/902

[58] Field of Search ..... 271/287, 297, 303, 304, 271/305, 291, 292, 294, 296, 298, 301, 902, 184, 225, 300, 302

[56] References Cited

U.S. PATENT DOCUMENTS

| | | | |
|---|---|---|---|
| 1,747,384 | 2/1930 | Olson et al. | 271/303 |
| 1,825,217 | 9/1931 | Tufts et al. | 271/303 |
| 3,848,868 | 11/1974 | Stemmle | 271/291 |
| 4,277,061 | 7/1981 | Nagel et al. | 271/303 X |
| 4,486,015 | 12/1984 | Takahashi | 271/305 |

FOREIGN PATENT DOCUMENTS

| | | | |
|---|---|---|---|
| 167351 | 10/1983 | Japan | 271/184 |
| 202247 | 11/1983 | Japan | 271/184 |
| 230955 | 12/1984 | Japan | 271/303 |
| 2125775 | 3/1984 | United Kingdom | 271/296 |

*Primary Examiner*—Kevin P. Shaver
*Assistant Examiner*—David H. Bollinger
*Attorney, Agent, or Firm*—Kenyon & Kenyon

[57] ABSTRACT

A paper control gate directs a sheet from any one to any other of a plurality of three or more stations angularly disposed about a single rotatable shaft mounting one or more vanes. The vanes are in general curved and deflect a sheet through an appreciable angle. Where there is little or no sheet deflection between stations, a pair of parallel vanes may provide a passageway. The vanes may be flared at each end to accommodate reversible sheet paths. Large shaft rotations are employed. The stations are equally spaced from the shaft and each is provided with a frictional sheet drive roller.

23 Claims, 2 Drawing Sheets

PAPER CONTROL GATE

This is a continuation of application Ser. No. 871,800 filed June 9, 1986, now abandoned.

BACKGROUND OF THE INVENTION

Where there is an intersection of three or more paper path branches, it is frequently desireable to be able to direct a paper sheet entering the intersection from any one of the branches or stations to any of the other branches or stations. For example, in a copying machine capable of duplex and multi-color overlay operation, there may be four stations; and it may be required to direct a sheet from a first station to any of the remaining three stations and to direct a sheet from a second station to either one of the third and fourth stations.

SUMMARY OF THE INVENTION

In general our invention contemplates a rotatable paper control gate provided with one or more curved vanes where the number of stations is odd. The control gate may further be provided with either one or a parallel pair of generally straight vanes where the number of stations is even. By selectively rotating the paper gate to different angular positions, a sheet from any given station can be directed to any other station.

One object of our invention is to provide a paper control gate which includes at least one curved vane, and may further include a pair of parallel straight vanes, which is rotatable substantially through a full revolution and which can be oriented to direct a sheet of paper along corresponding curved or straight paths.

Another object of our invention is to provide a paper control gate which can direct a sheet from any one to any other of three or more stations.

A further object of our invention is to provide a paper control gate having but a single moving part.

Other further objects of our invention will appear from the following description.

THE PRIOR ART

Takahashi Pat. No. 4,486,015 shows a gate having vanes mounted on two parallel shafts, the upper one of which is selectively rotatable 20° counterclockwise to block a straight-through path from left-to-right and deflect a sheet upwardly, and the lower one of which is selectively rotable 20° clockwise to block the straight-through path and deflect a sheet downwardly. The vanes are formed as wedges subtending 40°. Two shafts are required; and rotation of either shaft is limited to small angles appreciably less than 50° at which angle one wedge surface would be vertically disposed, at 90° to the paper path, and effectively stop further movement of a sheet.

BRIEF DESCRIPTION OF THE DRAWINGS

In the accompanying drawings which form part of the instant specification and which are to be read in conjunction therewith and in which like reference numerals are used to indicate like parts in the various views.

DESCRIPTION OF THE PREFERRED EMBODIMENTS

Figure 1:
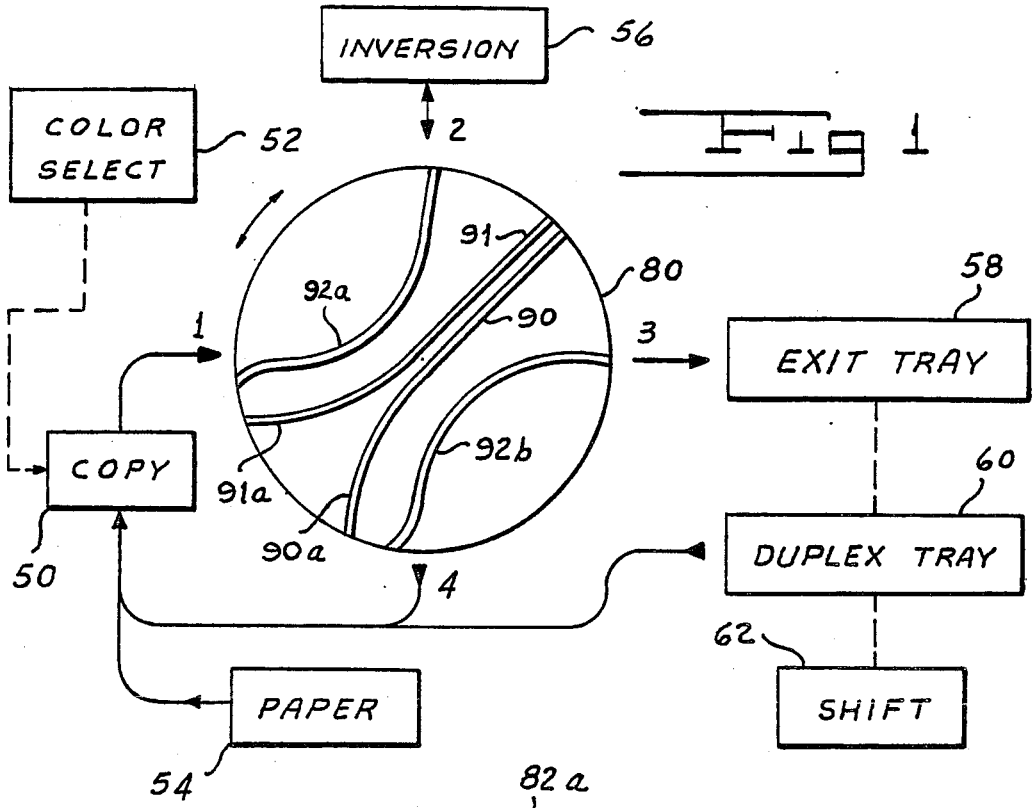
FIG. 1 is a diagrammatic side view showing a four station paper gate control in a duplex multi-color overlay copier.

Referring now to FIG. 1 of the drawings, the paper gate comprises four vanes 90, 91, **92*a* and 92*b* mounted on a rotatable disc 80. Paper enters or leaves the gate at one of four circumferentially disposed stations 1, 2, 3 and 4. Fresh paper is supplied from a source 54 to a copy machine 50. Copier 50 may print in one of a plurality of colors such as yellow, cyan, magenta and black under the control of a color selector 52. It may be assumed that as the paper passes upwardly through the copier 50, an image is provided on the left hand side of the paper. The image bearing sheet exiting from the copier 50 is directed to station 1 immediately to the left of disc 80**.

Vane **92*a* accepts paper travelling to the right and deflects it 90° in an upward direction to station 2. The inlet portion of vane 92*a* is provided with a short downwardly curving flared transition to guide paper onto the vane. If the disc 80 is rotated 90° clockwise from the position shown, then paper from station 1 passes to vane 92*b* which deflects paper 90° downwardly to station 4. Vane 92*b* is provided with a short entrance transition, which in the position shown flares to the left, to insure that paper is guided onto the vane. If disc 80 is rotated 45° clockwise from the position shown, then a pair of closely spaced parallel vanes 90 and 91 is operative to accept paper from station 1 and pass it straight through to station 3. In this operative position of vanes 90 and 91, the entrance end 90*a* of lower vane 90 is flared downwardly, while the entrance end 91*a* of upper vane 91 is flared upwardly to insure that the paper is guided into the passageway between the vanes 90 and 91**.

Paper exiting the gate at station 3 passes into an exit tray 58. Located below the exit tray 58 is a duplex tray 60 which can be selectively lifted into alignment with station 3 by a vertical shift mechanism 62. Any paper in the duplex tray 60 can, in the lowered position shown, be delivered to the copier 50. Paper exiting from the gate at station 4 is also delivered to the copier 50.

Paper exiting from the gate at station 2 is delivered to an inverter 56. The inversion operation performed at 56 may consist merely of holding the paper momentarily until the gate is shifted to a new position and then redelivering the held paper back into the gate at station 2.

In standard operation of the copier 50, paper from supply 54 is delivered to the copy machine; the gate is rotated 45° clockwise from the position shown; and paper entering at station 1 passes straight through to station 3 and into the exit tray 58.

Duplex operation can be performed either internally or externally. In external duplex operation, the duplex tray 60 is used. Shift mechanism 62 is operated to lift the duplex tray 60 into alignment with station 3. The gate is rotated 45° clockwise from the position shown; and paper from supply 54 passes through the copier 50 to station 1 and then straight through to station 3 and into the duplex tray 60. After the requisite number of copies have been made, the shift mechanism is operated to lower trays 58 and 60 until the exit tray is again in alignment with station 3. Paper from the duplex tray is now delivered through the copier 50 to station 1 and then straight through to station 3 and the exit tray 58.

For internal duplex operation, the duplex tray is not used. The paper gate is in the position shown; and paper from supply 54 passes through the copier 50 to station 1 where vane 92*a* deflects it to station 2 and inverter 56. Thereafter the gate is rotated 135° clockwise from the position shown; and paper from the inverter 56 passes straight downwardly through vanes 90 and 91 from station 2 to station 4 and back to the copier 50. After the trailing edge of the paper has left the gate, but before the leading edge of the paper arrive at station 1, the paper gate is rotated 45° clockwise from the position shown, that is 90° counterclockwise from its immediately prior position, so that paper from station 1 is now delivered by vanes 90 and 91 straight through to station 3 and the exit tray 58. Thereupon the gate control is rotated 45° counterclockwise back to the position shown so that another sheet of paper from supply 54 will be delivered from station 1 to station 2 and inverter 56.

Overlay operation in different colors may be performed either internally or externally. External overlay operation is performed with the duplex tray by operating the shift mechanism 62 to move the duplex tray 60 into alignment with station 3 For external overlay, only two colors may be provided. With color selector 52 set to provide the first color, paper from supply 54 passes through the copier 50. The gate is set to the position shown; and paper from station 1 is deflected upward by vane 92*a* to station 2 and inverter 56. Thereafter the gate is rotated 90° clockwise from the position shown. Paper from inverter 56 is deflected to the right by vane 92*a* and passes from station 2 to station 3 and the duplex tray 60. The paper gate is then rotated 90° counterclockwise back to the position shown for making a copy in the first color on a subsequent sheet of paper from supply 54. After the desired number of copies are in the duplex tray 60, shift mechanism 62 is actuated to lower the exit tray into alignment with station 3. Color selector 52 is actuated to produce the second color for external overlay. The gate is rotated 45° clockwise from the position shown to bring vanes 90 and 91 into operation at station 1. Thereupon paper from the duplex tray 60 is delivered to the copier 50. Paper from station 1 passes straight through to station 3 and exit tray 58.

For internal overlay operation, three or more colors may be provided. Color selector 52 is set to provide sequentially the desired colors, as for example black and yellow or black and yellow and cyan. Paper from supply 54 passes through the copy machine 50 where, in the example given, a black copy is first made, and the sheet passes to station 1. The paper gate is rotated 90° clockwise from the position shown to bring vane 92*b* into position opposite station 1. Paper passes from station 1 to station 4. After the trailing edge of the copy sheet has left the paper gate, the color selector 52 now sequentially provides the second color, which is yellow in the example given. Paper passes from station 4 through the copier 50 to station 1. If a third color has been selected, then the paper gate is left in the position where vane 92*b* is operative to deflect paper from station 1 to station 4. When the trailing edge of the sheet leaves the paper gate, color selector 52 now sequentially provides the third color, which is cyan for the example given. Paper passes through the copier 50 to station 1. If only three colors have been selected, then the paper gate is rotated 45° counterclockwise from its previous position, which is 45° clockwise from the position shown, so as to bring vanes 90 and 91 into position opposite station 1. Paper now passes from station 1 straight through to station 3 and exit tray 58.

Figure 4:
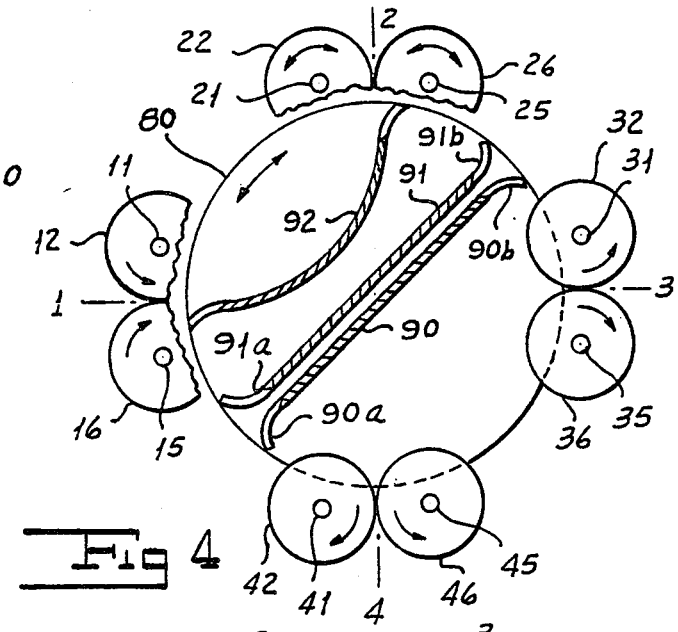
FIG. 4 is a side sectional view of the alternate four station paper gate control taken along the line 4—4 of FIG. 2.

FIG. 4 shows a modified form of the paper gate shown in FIG. 1. In FIG. 4, vanes 90 and 91 are for the most part straight, the entrance flares 90*a* and 91*a* being of reduced length. Furthermore, vanes 90 and 91 are provided with corresponding exit flares 90*b* and 91*b*. Vane 92*b* of of FIG. 1 is omitted; and vane 92 of FIG. 4, which replaces vane 92*a* of FIG. 1, is provided with a short exit flare adjacent station 2 in the position shown which curves upwardly and to the right. In FIG. 4, the vanes 90 and 91 are thus reversible so that either end may be the entrance and the other end will correspondingly be the exit. Furthermore, vane 92 may accommodate a paper path in either direction so that paper may enter at station 1 and exit at station 2 or may enter at station 2 and exit at station 1. Thus in FIG. 4 for internal overlay operation where paper from station 1 is deflected to station 4, the paper gate is rotated 90° counterclockwise from the position shown; and the paper path along vane 92 is thereby reversed from that in the position shown. In FIG. 1, it will be recalled that t deflect paper from station 1 to station 4 requires a 90° clockwise rotation of the paper gate to bring vane 92*b* into position.

Figure 2:
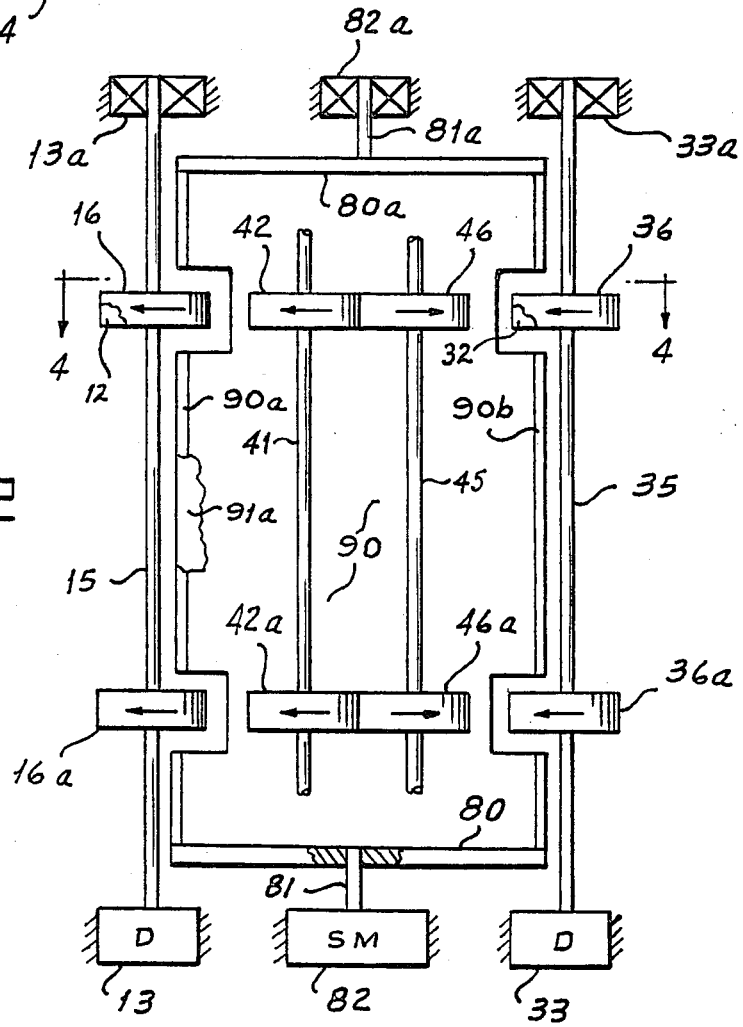
FIG. 2 is a bottom view of a four station paper gate control alternate to that of FIG. 1.

Referring now to FIGS. 2 and 4, station 1 is defined by a pair of opposed counter-rotating friction feed wheels 12 and 16 mounted on respective shafts 11 and 15. Displaced along shaft 15 is one feed wheel 16*a* of a further pair of opposed feed wheels. Shaft 15 is driven at one end by a motor 13 and is supported at its other end by a bearing 13*a*. Station 4 is defined by pair of opposed counter-rotating friction feed wheels 42 and 46 mounted on respective shafts 41 and 45. Displaced along shafts 41 and 45 are a further pair of opposed feed wheels 42*a* and 46*a*. Station 3 is defined by a pair of counter-rotating feed wheels 32 and 36 mounted on respective shafts 31 and 35. Displaced along shaft 35 is one feed wheel 36*a* of a further pair of opposed feed wheels. One end of shaft 35 is driven by a motor 33; and the other end of the shaft is supported by a bearing 33*a*. Station 2 is defined by pair of opposed counter-rotating feed wheels 22 and 26 mounted on respective shafts 21 and 25. A further pair of opposed feed wheels (not shown) are provided at spaced positions along shafts 21 and 25. One or both of shafts 21 and 25 are driven by a reversible motor (not shown). One or both of shafts 41 and 45 are driven by a motor similar to 13 and 33. The vanes are mounted between discs 80 and 80*a*. The ends of the vanes pass adjacent the shafts of the feed wheels. Each vane is provided with upper cutouts (FIG. 2) to accommodate passage by feed wheels 16, 42, 46 and 36 and with lower cutouts to accommodate passage by feed wheels 16*a*, 42*a*, 46*a*, and 36*a*. Disc 80 is secured to a shaft 81 driven by a servo motor or stepping motor 82. Disc 80*a* is secured to a shaft 81*a* which is journalled in a bearing 82*a*.

It will understood that the embodiments of FIGS. 1, 2 and 4 are adapted to direct a paper from any one station to any other of four stations. In FIG. 1 the particular application is a multi-color overlay duplex copier wherein the paper may be delivered from station 1 to any of stations 2, 3 and 4 and from station 2 to either of station 3 and 4. Accordingly, in the copier application shown, shafts 11, 15, 31, 35, 41 and 45 always rotate in the directions shown; while shafts 21 and 25, alternately rotate in one direction and then in the reverse direction during inversion at 56, since station 2 is alternately an exit station and an entrance station. In another application, motors 13 and 33 may be reversible.

Figure 3:
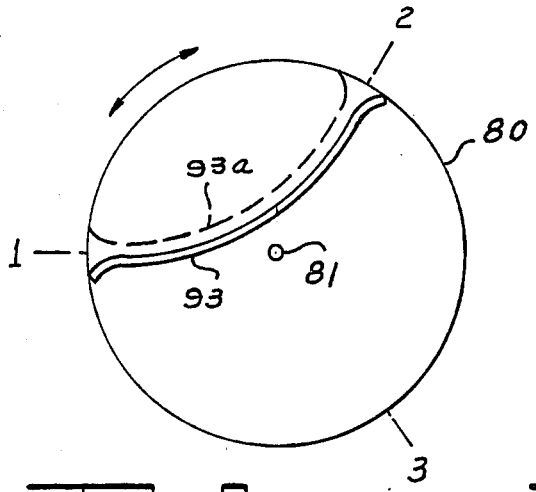
FIG. 3 is a side view of a three station paper gate control.

Referring now to FIG. 3, there is shown a paper gate for delivering paper from any one station to any other of three stations angularly separated by 120°. A stepping motor shaft 81 drives disc 80 to which is secured a single vane 93. In the position shown vane 93 deflects a sheet entering at station 1 upwardly and to the right to station 2 or alternately deflects a sheet entering at station 2 downwardly and to the left to station 1. Along either paper path, the sheet is deflected through 60°. The ends of the vane 93 are provided with short downwardly flaring transitions to ensure smooth entry of paper at either end of the vane.

It will be noted that in FIGS. 1 and 4 the straight-through paper path is provided by a pair of vanes 90 and 91 having a closely spaced parallel portion. Where the paper path is straight, the paper might buckle in either direction; and the pair of substantially parallel vanes 90 and 91 ensures that the paper will be delivered along the straight-through path with limited buckling in either direction. It will be noted in FIGS. 1 and 4 that the vanes 92*a* and 92*b* or 92 deflect the paper through 90° from a straight-through path. It is assumed that the resulting bending moments in the paper are sufficiently high to prevent the paper from buckling in a direction tending to increase the amount of deflection of the paper. These bending moments tend to cause the paper to straighten itself out and are assumed sufficiently great for deflections of 90° that no auxiliary vane parallel to vanes 92*a*, 92*b* or 92 need be provided. In FIG. 3, the angular deflection of vane 93 is only 60°. If desired, an auxiliary vane 93*a* may be provided which is disposed above and generally parallel to vane 93 but which has upwardly flared ends. For very thin paper or very high speeds of paper movement, this limits the extent to which paper may be lifted from vane 93 by air currents. Rotation of the gate 120° counterclockwise from the position shown results in the interconnection of stations 1 and 3. Rotation of the gate 120° clockwise from the position shown interconnects stations 2 and 3.

Figure 5:
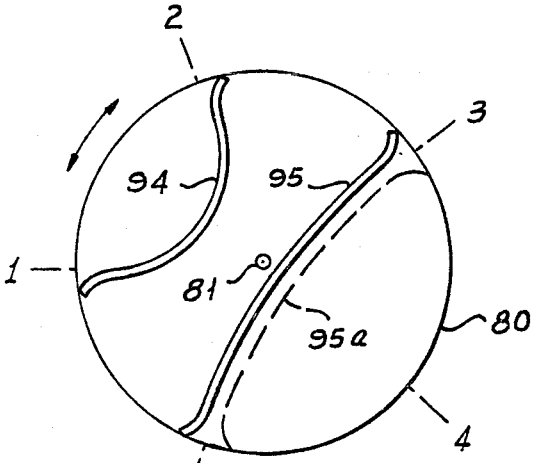
FIG. 5 is a side view of a five position paper gate control.

Referring now to FIG. 5, there is shown a paper gate for connecting any one station to any other of five stations angularly spaced by 72°. Stepping motor shaft 81 is secured to disc 80 which carries two vanes 94 and 95. Vane 94 in the position shown connects station 1 and 2 and deflects a sheet through 108°. Also in the position shown, vane 95 connects stations 3 and 5 and deflects a sheet through 36°. Since the deflection provided by vane 95 is less than 90°, it may be desireable to provide an auxiliary vane 95*a* generally parallel to vane 95. Each of vanes 94 and 95 is provided with outwardly flaring end sections. The auxiliary vane 95*a*, if provided, has end sections which flare oppositely to those of vane 95. Rotation of the gate 72° clockwise from the position shown results in the interconnection of station 2 and 3 through vane 94 and also the interconnection of stations 1 and 4 through vane 95. Rotation of the gate 144° clockwise from the position shown results in the interconnection of stations 3 and 4 by vane 94 and the interconnection of stations 2 and 5 by vane 95. Rotation of the paper gate 72° counterclockwise from the position shown results in the interconnection of station 1 and 5 by vane 94 and the interconnection of stations 2 and 4 by vane 95. Rotation of the gate counterclockwise through 144° from the position shown results in the interconnection of stations 4 and 5 by vane 94 and the interconnection of stations 1 and 3 by vane 95.

Figure 6:
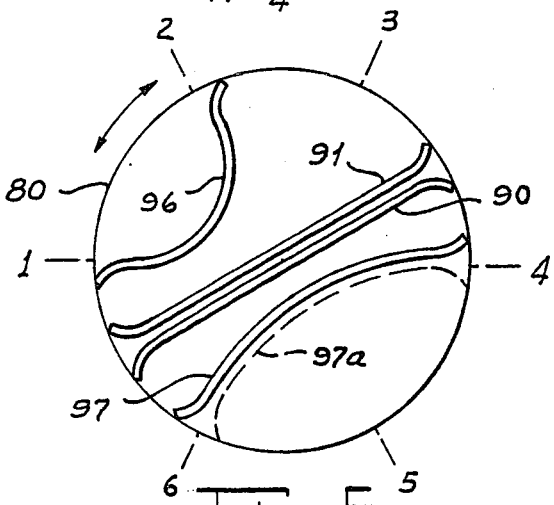
FIG. 6 is a side view of a six position paper gate control.

Referring now to FIG. 6, there is shown a gate for connecting any one station to any other of six stations equally spaced by 60°. A straight-through paper path is provided by generally parallel vanes 90 and 91 which may be of a construction similar to that shown in FIG. 4. Vane 96 deflects the paper through 120° and interconnects stations 1 and 2 in the position shown. Vane 97 deflects the paper through 60° and interconnects stations 4 and 6. Since the deflection provided by vane 97 is less than 90°, auxiliary vane 97*a* may be provided. Rotating the gate 30° clockwise from the position shown, results in the interconnection of stations 1 and 4 through the straight-through vanes 90 and 91. Rotation of the gate 30° counterclockwise from the position shown results in the interconnection of stations 3 and 6 through the straight-through vanes 90 and 91. Rotation of the gate plus or minus 90° from the position shown results in the interconnection of stations 2 and 5 through the straight-through vanes 90 and 91. Rotation of the gate 60° clockwise from the position shown results in the interconnection of stations 2 and 3 through vane 96 and the interconnection of stations 1 and 5 through vane 97. Rotation of the gate 120° clockwise from the position shown results in the interconnection of stations 3 and 4 through vane 96 and the interconnection of stations 2 and 6 through vane 97. Rotation of the gate plus or minus 180° from the position shown results in the interconnection of stations 4 and 5 through vane 96 and the interconnection of station 1 and 3 through vane 97. Rotation of the gate 60° counterclockwise from the position shown results in the interconnection of station 1 and 6 through vane 96 and the interconnection of stations 3 and 5 through vane 97. Rotation of the gate 120° counterclockwise from the position shown results in the interconnection of stations 5 and 6 through vane 96 and the interconnection of stations 2 and 4 through vane 97.

Figure 7:
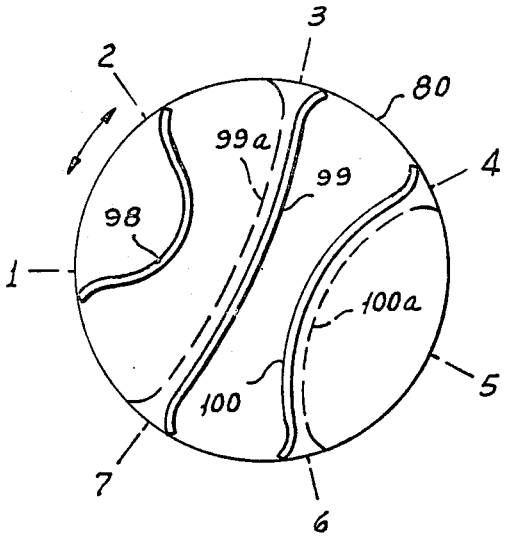
FIG. 7 is a side view of a seven position paper gate control.

Referring now to FIG. 7 of the drawings, there is shown a gate for connecting any one station with any other of seven stations angularly displaced by approximately 51.4°. Three vanes are secured to rotable disc 80. Vane 98 deflects the paper through approximately 128.6° and affords communication between stations 1 and 2 in the position shown. Vane 99 deflects the paper through approximately 25.7° and in the position shown provides communication between stations 3 and 7. Since the deflection is appreciably less than 90°, an auxiliary vane 99*a* may be provided. Vane 100 deflects the paper through approximately 77.1° and provides communication between stations 4 and 6. Since the deflection is less than 90°, an auxiliary vane 100*a* may be provided. Rotation of disc 80 clockwise through approximately 51.4° from the position shown provides communication between stations 2 and 3 through vane 98, provides communication between stations 1 and 4 through vane 99, and provides communication between stations 5 and 7 through vane 100. Rotation of disc 80 counterclockwise through approximately 51.4° from the position shown provides communication between stations 1 and 7 through vane 98, provides communication between stations 2 and 6 through vane 99, and provides communication between stations 3 and 5 through vane 100. Rotation of disc 80 clockwise through approximately 102.9° from the position shown provides, for example, communication between stations 3 and 4 through vane 98; and clockwise rotation of disc 80 through approximately 154.3° from the position shown provides, for example, communication between stations 4 and 5 through vane 98. Similarly counterclockwise rotation through approximately 102.9° from the position shown provides communication, for example, between stations 6 and 7 through vane 98; and counterclockwise rotation through approximately 154.3° from the position shown provides, for example, communication between stations 5 and 6 through vane 98.

Figure 8:
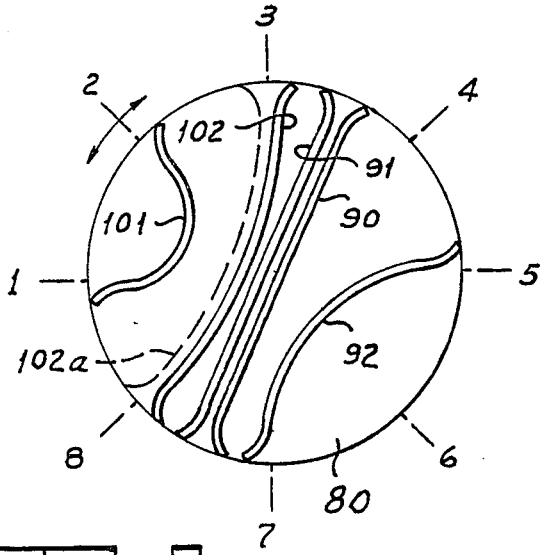
FIG. 8 is a side view of a eight position paper gate control.

Referring now to FIG. 8 there is shown a paper gate providing communication between any one station and any other of eight stations angularly spaced by 45°. Parallel vanes 90 and 91 provide a straight-through paper path and may be similar to the vanes shown in FIGS. 4 and 6. In the position shown, a vane 101 provides communication between stations 1 and 2 and deflects the paper through 135°. Vane 102 deflects the paper through 45° and provides communication between stations 3 and 8. Since the deflection is less than 90° an auxiliary parallel vane 102*a* may be provided. In the position shown, vane 92 deflects the paper through 90° and provides communication between stations 5 and 7. If the gate is rotated 22.5° clockwise from the position shown, straight-through vanes 90 and 91 provide communication between stations 4 and 8. If disc 80 is rotated 22.5° counterclockwise from the position shown, then straight-through vanes 90 and 91 provide communication between stations 3 and 7. Clockwise rotation of disc 80 through 67.5° interconnects stations 1 and 5; and counterclockwise rotation of disc 80 through 67.5° interconnects stations 2 and 6, through straight-through vanes 90 and 91. If disk 80 is rotated 45° clockwise from the position shown, vane 101 provides communication between stations 2 and 3; vane 102 provides communication between stations 1 and 4; and vane 92 provides communication between stations 6 and 8. If disc 80 is rotated 45° counterclockwise from the position shown, then vane 101 provides communication between stations 1 and 8; vane 102 provides communication between stations 2 and 7; and vane 92 provides communication between stations 4 and 6. It will further be apparent that for clockwise rotation through 90° from the position shown, vane 101 provides communication between stations 3 and 4; for clockwise rotation through 135°, vane 101 provides communication between stations 4 and 5; and for rotation in either direction through 180°, vane 101 provides communication between stations 5 and 6. Similarly, for counterclockwise rotation through 90° from the position shown, vane 101 provides communication between stations 7 and 8; and for counterclockwise rotation through 135°, vane 101 provides communication between stations 6 and 7.

It will be appreciated that in FIGS. 3 through 8 we show paper gates with the minimum number of vanes for reversibly connecting any one station to any other of a plurality of equally spaced stations. It will be understood that we need not use the minimum number of vanes; the stations need not be spaced at equal angles; and in many applications it may not be required that each station communicate either in one direction or reversibly with every other station. For example in FIG. 8, the omission of vane 101 results in a structure where any station can be reversibly connected with any other station except the two stations immediately adjacent.

In general where the number of stations S is odd, the minimum number of vanes V is: $V=(S-1)/2$. Where the number of stations is even, then the minimum number of vanes is: $V=S/2+1$. We assume that two vanes are provided for the straight-through paper path. However, where the paper is guided with some accuracy at the stations, vanes 90 and 91 may be appreciably truncated, fragmented, or even entirely omitted in providing a straight-through paper path. Of course the paper should be fairly stiff or be transported at relatively low speeds in traversing a straight-through path having minimal or even no guidance by the gate itself. In such event the minimum number of vanes is: $V=S/2-1$.

Two adjacent vanes may be combined to form a relatively thick solid or hollow structure. For example, in FIG. 1 vanes 91 and 92*a* can be combined into one common structure; and vanes 90 and 92*b* likewise can be combined into one common structure. Similarly, in FIG. 4 vanes 91 and 92 can be combined into one common structure. In FIG. 5, vanes 94 and 95 can be combined. In FIG. 6, vanes 91 and 96 can be combined; and vanes 90 and 97 can also be combined. In FIG. 7, vanes 99 and 100 can be combined; and if vane 99*a* were provided, it could be combined with vane 98. In FIG. 8, vanes 90 and 92 can be combined; vanes 91 and 102 can also be combined; and if vane 102*a* were provided, it could be combined with vane 101.

Furthermore the relative alignment of the vanes may be varied. In FIGS. 1, 4, 6 and 8 the bringing of the straight-through vanes into position requires an angular rotation of the gate from the position shown which is half the angle between adjacent stations. The number of steps of the stepping motor is thus twice the number of stations. By repositioning the vanes, the number of steps of the stepping motor can be reduced to the same as the number of stations. For example, in FIG. 1 vanes 91 and 90 may be repositioned on disc 80 by 45° counterclockwise from that shown so that the straight exit portions of vanes 92*a* and 91 contact one another. Furthermore, vane 92*b* may be repositioned on disc 80 by 90° counterclockwise from that shown so that the straight exit portions of vanes 90 and 92*b* contact one another. With such reorientation of vanes 90, 91 and 92*b*, the straight-through vanes 90 and 91 as well as the 90° deflecting vanes 92*a* and 92*b* will all exit adjacent station 2. Vanes 92*a* and 92*b* should also have a slightly reduced radius of curvature so that vane 92*a* exits slightly to the left of station 2, vanes 90 and 91 exit at station 2, and vane 92*b* exits slightly to the right of station 2. With such repositioning of the vanes 90, 91 and 92*b*, the straight-through path from station 1 to station 3 would be provided with a 90° clockwise rotation of the gate; and the path from station 1 to station 4 would be provided with a plus or minus 180° rotation of the gate. In FIG. 6, vanes 90 and 91 may be repositioned on disc 80 by 30° counterclockwise from that shown so that the upper ends of the vanes 90 and 91 are at station 3 and the lower ends of vanes 90 and 91 are adjacent station 6. Vane 97 should have a slightly reduced radius of curvature so that its lower end and the lower end of vane 90 substantially contact one another at station 6. Similarly in FIG. 8, vanes 90 and 91 may be repositioned on disc 80 22.5° clockwise of the position shown so that the upper end of vanes 90 and 91 are at station 4 and the lower ends of the vanes are adjacent station 8 Vane 102 should have a slightly reduced radius of curvature so that its lower end and the lower end of vane 91 substantially contact one another at station 8.

It will be seen that we have accomplished the objects of our invention. Our paper gate has but a single moving part and can be rotated to various angular positions to direct a sheet from any one to any other of three or more stations. The gate includes at least one vane which may be curved where the number of stations is odd. Where the number of stations is even, a straight-through paper path may be passively permitted; and such straight-through path may further be defined by either a full or fragmentary form of either one or a pair of parallel guiding vanes. Multiple vanes may be combined to form solid or hollow structures having two paper deflecting surfaces selectively operative at various angular positions. Various of the vanes may exit at substantially the same station. Where the number of stations is odd, the servo motor or stepping motor for the control gate will have a number of positions which in general is equal to the number of stations. Where the number of stations is even, the stepping motor or servo motor for the control gate will have a number of positions which may either be equal to or twice the number of stations. Where the paper path is either straight or provides a relatively small deflection, it may be defined by a pair of parallel vanes forming a passageway.

It will be understood that certain features and subcombinations are of utility and may be employed without reference to other features and subcombinations. This is contemplated by and is within the scope of our claims. It will be further obvious that various changes may be made in details within the scope of our claims without departing from the spirit of our invention.

Having thus described our invention, what we claim is:

1. A sheet gate including in combination a rotatable shaft, a plurality of at least three stations angularly disposed about the shaft, vane means for directing a sheet along a path from any of said stations to any other of said stations, said vane means including a plurality of vanes mounted on the shaft, said pair of vanes including closely spaced and generally parallel portions defining a passageway therebetween, and means for rotating the shaft to a plurality of angular positions at each of which the vane means is operative to permit movement of a sheet from one of said stations to another of said stations.

2. A sheet gate as in claim 1, wherein the passageway is generally straight.

3. A sheet gate as in claim 1, wherein the passageway is curved.

4. A sheet gate as in claim 1, wherein the rotating means is further operative to rotate the shaft to a first angular position at which the vane means is operative to pass a sheet between a first station and a second station, and to rotate the shaft to a second angular position at which the passageway is operative to guide a sheet between the first station and a third station.

5. A sheet gate as in claim 1, where the number of stations, S, is an even number and $S \geqq 4$, and the number of vanes, V, is defined as $V \geqq S/2+1$, and the number of different angular positions for each of which the vane means is operative to pass a sheet from one of said stations to another of said stations is at least equal to the number of stations.

6. A sheet gate as in claim 5, wherein the vanes have two ends and a plurality of the vanes V are appreciably flared on each end.

7. A sheet gate including in combination a rotatable shaft, a plurality of at least three stations angularly disposed about the shaft, vane means for directing a sheet along a path from any of said stations to any other of said stations, said vane means including at least a first vane mounted on the shaft, and means for rotating the shaft to a plurality of angular positions at each of which the vane means is operative to deflect a sheet from one of said stations through an appreciable angle to another of said stations.

8. A sheet gate as in claim 7, wherein the first vane has two ends, one of the ends being adjacent to a second station in a first angular position at which the vane means is operative to deflect a sheet between a first station and said second station, and the other end being adjacent to a third station in a second angular position at which the vane means is operative to deflect a sheet between said first station and said third station.

9. A sheet gate as in claim 8, wherein the first and second angular positions differ by at least 50°.

10. A sheet gate as in claim 8, wherein the first and second angular positions differ by at least 45°.

11. A sheet gate as in claim 8, wherein each of said ends of the first vane is appreciably flared.

12. A sheet gate as in claim 7, wherein the first vane is curved, wherein the vane means further includes a second curved mounted on the shaft, and wherein the first vane is operative in a first angular position to deflect a sheet between a first station and a second station and the second vane is operative at the second angular position to deflect a sheet between the first station and a third station.

13. A sheet gate as in claim 7, wherein each of said stations includes a friction roller adapted to bear against one surface of a sheet passing thereby.

14. A sheet gate as in claim 7, wherein said rotating means is further operative to rotate the shaft to a first angular position at which the vane means is operative to guide a sheet between a first station and a second station, to rotate the shaft to a second angular position at which the vane means is operative to pass a sheet between the first station and a third station, and to rotate the shaft to a third angular position at which the vane means is operative to guide a sheet between the second station and the third station.

15. A sheet gate as in claim 7, where the number of stations, S, is an odd number and $S \geqq 3$, the number of vanes, V, is defined as $V \geqq (S-1)/2$, and the number of different angular positions at each of which the vane means is operative to guide a sheet from one of said stations to another of said stations is at least equal to the number of stations.

16. A sheet gate as in claim 15, wherein the vanes have two ends and a plurality of the vanes V are appreciably flared on each end.

17. A sheet gate as in claim 7, where is number of stations, S, is an even number and $S \geqq 4$, the number of vanes, V, is defined as $V \geqq S/2-1$, and the number of different angular positions at each of which the vane means is operative to pass a sheet from one of said stations to another of said stations is at least equal to the number of stations.

18. A sheet gate as in claim 17, wherein two stations are angularly spaced by approximately 180° about the shaft, and wherein at one of said angular positions the vane means is operative to permit movement of a sheet between said two stations.

19. A sheet gate as in claim 17, wherein the vanes have two ends and a plurality of the vanes V are appreciably flared on each end.

20. A sheet gate as in claim 7, further comprising at least four stations angularly disposed about the shaft.

21. A sheet gate as in claim 20, said rotating means being further operative to rotate the shaft to a first angular position at which the vane means is operative to guide a sheet between a first station and a second station, to rotate the shaft to a second angular position at which the vane means is operative to pass a sheet between the first station and a third station, and to rotate the shaft to a third angular position at which the vane means is operative to guide of a sheet between the first station and a fourth station.

22. A sheet gate as in claim 21, wherein the third station is angularly spaced from the first station by approximately 180° about the shaft.

23. A sheet gate as in claim 7, wherein said stations are disposed at substantially equal distances from the shaft.

* * * * *